United States Patent [19]

Dubiel et al.

[11] 4,090,646

[45] May 23, 1978

[54] SOFT FOOD DISPENSER

[76] Inventors: John A. Dubiel; Bernice R. Dubiel, both of 273 Raymond Ave., Cheektowaga, N.Y. 14227

[21] Appl. No.: 727,783

[22] Filed: Sep. 29, 1976

[51] Int. Cl.[2] ..... B65D 47/20

[52] U.S. Cl. ..... 222/326; 222/340; 222/387; 222/505

[58] Field of Search ..... 222/326, 340, 387, 386, 222/505, 507, 513, 515, 519

[56] References Cited

U.S. PATENT DOCUMENTS

| | | | |
|---|---|---|---|
| 1,361,290 | 12/1920 | Spruill | 222/519 X |
| 2,626,730 | 1/1953 | Gabler | 222/326 |
| 2,666,555 | 1/1954 | Hill | 222/340 |

*Primary Examiner*—Allen N. Knowles
*Assistant Examiner*—John P. Shannon
*Attorney, Agent, or Firm*—Christel & Bean

[57] ABSTRACT

A dispenser for soft foods and the like including a thin-walled container having a piston assembly threaded to one end and including a cap element having an aperture in the end surface, a piston head within the container, a coil spring extending through the aperture and a knob rotatably connected to the cap and fixed to the other end of the spring. Rotation of the knob compresses the spring in the region between the piston head and cap end surface to store energy for dispensing the food. A dispenser assembly is threaded to the opposite end of the container and includes a nozzle, a container outlet in communication with the nozzle and a valve element for opening and closing the outlet. A spring-biased actuator element has a rack portion engaging a pinion portion of the valve element, and the actuator element is moved by a handle lever pivoted to the container.

8 Claims, 5 Drawing Figures

3
142
98
114
112
86
58
80
78
60
62
72
100
3
106
104
10
14
20
16
36
26
38
22
28
24
40
48
30
50
50
32
44
18
46
52

144
138
142
134
138
94
70
130
5
126
5
90
88
84
92
86
78
120
80
66
58
72
68

144
142
134
138
136
74
138
138
70
120
126
72

86
78
84
120
92
94
128
130
70
126
72
58
98
96
88
90
116
82
114

88
96
116
78
114
108
106
92
704
84
144
142
58
112
120
86
94
90
98
110

SOFT FOOD DISPENSER

BACKGROUND OF THE INVENTION

This invention relates to the dispensing art, and more particularly to a new and improved manually-operated dispensing container for fluent material.

One area of use of the present invention is storing and dispensing flowable soft food material although the principles of the present invention can be variously applied. It would be highly desirable to provide a manually-operated dispensing container for flowable soft food material which dispenses the food relatively quickly in a manner preventing waste. It also would be highly desirable to provide such a dispensing container which is easy to operate and relatively simple in construction.

SUMMARY OF THE INVENTION

It is, therefore, an object of this invention to provide a new and improved manually-operated dispensing container for fluent material.

It is a further object of this invention to provide such a dispensing container which dispenses the fluent material relatively quickly in a manner preventing waste.

It is a further object of this invention to provide such a dispensing container which is convenient and easy to operate and which is relatively simple in construction.

The present invention provides a manually-operated dispensing container for fluent material comprising a hollow container for storing the material, piston means connected to one end of the container for pushing the material toward the opposite end of the container and manually-operated dispensing means connected to the opposite end of the container. The piston means comprises a plunger, biasing means urging the plunger toward the opposite end of the container, and manually-operated means operatively connected to the biasing means for causing the biasing means to store a sufficient amount of energy to force all of the fluent material in the container to the dispensing means. The dispensing means comprises nozzle means, valve means operatively between the nozzle means and container, causing the biasing means to store a sufficient amount of energy to force all of the fluent material in the container to the dispensing means. The dispensing means comprises nozzle means, valve means operatively between the nozzle means and container, and manually-operated actuator means for opening and closing the valve means. The piston means and dispensing means preferably are threaded onto the container whereby the container can be provided with threaded caps for storing the fluent material prior to dispensing for use.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENT

The soft food dispenser according to the present invention is particularly adapted for dispensing and spreading soft foods such as peanut butter, jelly, margarine, cheese spread, mustard, ketchup and the like. The dispenser includes a container having a piston assembly connected at one end and provided with means for storing sufficient energy to force or move a piston head along within the container to dispense all of the soft food stored therein. The dispenser also includes a dispensing assembly connected to the other end of the container and comprising a nozzle and a manually-operated valve assembly which is biased to a normally-closed position. The soft food is dispensed quickly and easily in response to manual operation of the valve assembly which is closed quickly and positively after use thereby avoiding waste.

Figure 1:
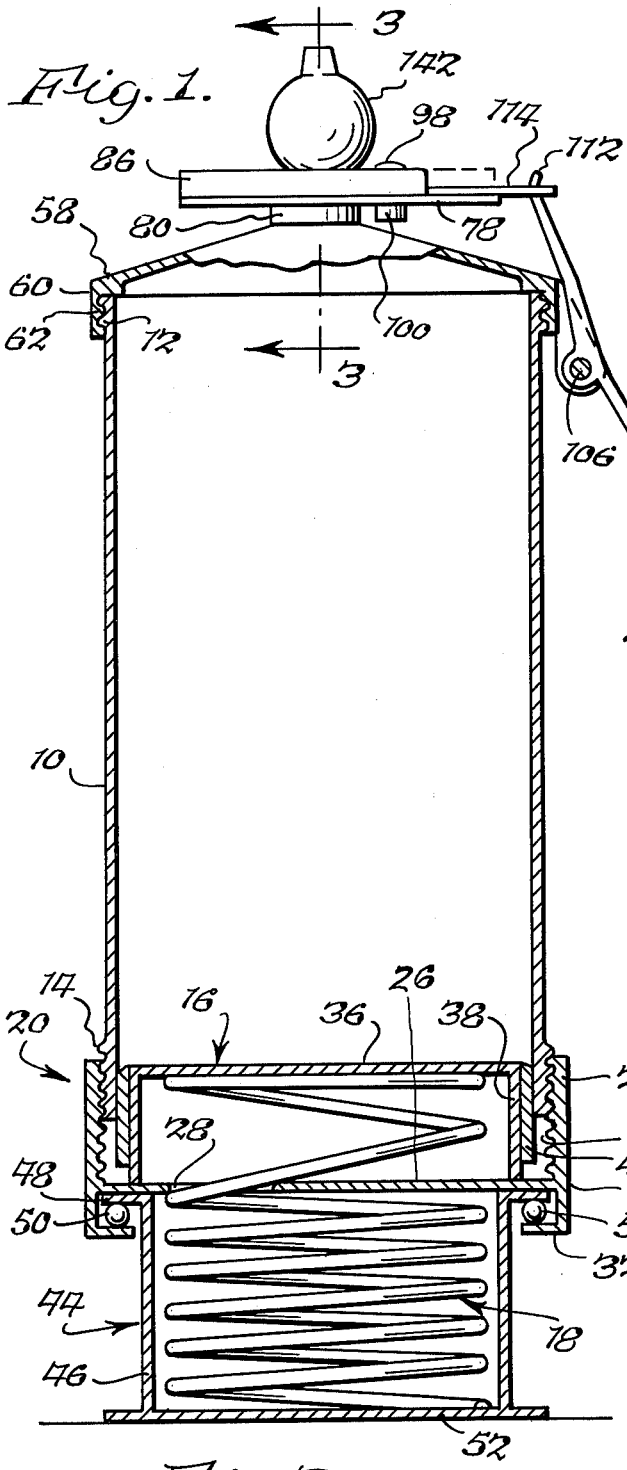
FIG. 1 is a longitudinal sectional view, with parts shown in elevation, of a dispensing container according to the present invention.

Referring now to FIG. 1, the soft food dispenser according to the present invention comprises a hollow container 10 for storing the food material which container is relatively thin-walled and of a material providing sufficient strength and rigidity, such as glass, plastic or metal. Container 10 is hollow cylindrical in shape and is provided with external regions of threads 12 and 14 adjacent the opposite ends thereof. The dispenser of the present invention further comprises piston means connected to one end of container 10 and including a piston head generally designated 16 movable along within container 10 and biasing means generally designated 18 for urging the piston head 16 in a direction toward the opposite end of container 10. In particular, there is provided a cap or cover element including an annular wall 22 having threads 24 along the inner surface thereof which cover member is of a diameter permitting it to be connected onto container 10 with threads 24 connected onto threads 14 of container 10. The cap including annular wall 22 is of suitable material, for example plastic, and includes an end wall portion 26 within the annular wall 22 and having an aperture or opening 28 therein for a purpose to be desribed. The wall 26 is axially spaced from the end of wall 22 which is connected onto container 10 and is disposed in a plane generally perpendicular to the longitudinal axis of container 10. As illustrated in FIG. 1, wall 26 provides a stop surface for piston head 16 at this end of container 10. The annular wall 22 of the cap element is extended axially beyond the wall 26 and includes a first portion 30 forming an annular axial extension of wall 22 and a second portion 32 which extends radially inwardly from portion 30 for a short distance thereby defining an annular recess or region with the wall 26 for a purpose to be described.

The piston head 16 is of suitable material, preferably plastic, and is somewhat cup-shaped including a disc-shaped wall portion 36 defining an end face which is disposed toward the opposite end of container 10 and an annular wall 38 extending axially from the wall 36. The walls 36, 38 are relatively thin but of sufficient rigidity thereby defining an interior region within the piston head 16. The outer diameter of the annular wall 38 is less than the inner diameter of container 10 by an amount sufficient to accommodate a piston ring or bearing element 40 fixed to the outer surface of annular wall 38 such as by means of a suitable adhesive. The piston ring element 40 preferably is of felt material although other materials having suitable bearing qualities can be employed. Ring 40 also serves as a seal to prevent escape of the fluent material such as soft food within container 10 in a direction opposite the movement of piston head 16.

The biasing means 18 in the form of a coil spring of metal such as spring steel having a portion which extends through aperture 28 of wall 26 and is received in the interior of piston head 16. The end of spring 18 engages the interior surface of piston end wall 36 but need not be fixed thereto. The remainder of the coil spring 18 is positioned on the opposite side of wall 26 and is fixed at the other end thereof to manually-operated spring conditioning means rotatably connected to the cap or cover element. In particular, a generally cup-shaped operator or knob element generally designated 44 and including an annular wall 46 having an outer diameter enabling it to fit with a small clearance within the radially-directed wall portion 32 and which terminates in a radially outwardly directed annular wall portion 48. Portion 48 is of a radial dimension enabling it to fit within the recess defined by the annular wall portion 30 and contacts or abuts the outer surface of wall 26. A plurality of ball bearing elements 50 are captively received in the annular recess or channel and contact the wall portions 48 and 32 providing an anti-friction contact therebetween. The element 44 is closed at the opposite end by an axial end wall 52 which extends slightly radially outwardly from the annular wall 46 thereby defining a chamber or region within the element 44 for receiving the remainder of the coil spring 18. The end of coil spring 18 is suitably fixed to the inner surface of wall 52.

The apparatus of the present invention further comprises dispensing means connected to the opposite end of container 10 which in response to manual operation thereof provides a positive and controlled dispensing or release of fluent material, i.e. soft food material, from within the container 10 and without any waste or leakage. The dispensing means comprises conduit means leading from container 10 and providing an outlet nozzle means spaced from the outlet and manually-operated valve means operatively between the outlet and nozzle. In particular, there is provided a cover element 58 which is somewhat cup-shaped having a slightly dome-shaped main body portion and an annular wall portion 60 leading axially therefrom. Cover 58 is of suitable material such as metal or plastic. Wall portion 60 is provided with threads 62 along the interior surface thereof, and the interior diameter of annular wall 60 is such that it is connected on the end of container 10 with threads 62 thereof connected onto the threads 12 of container 10.

Figure 3:
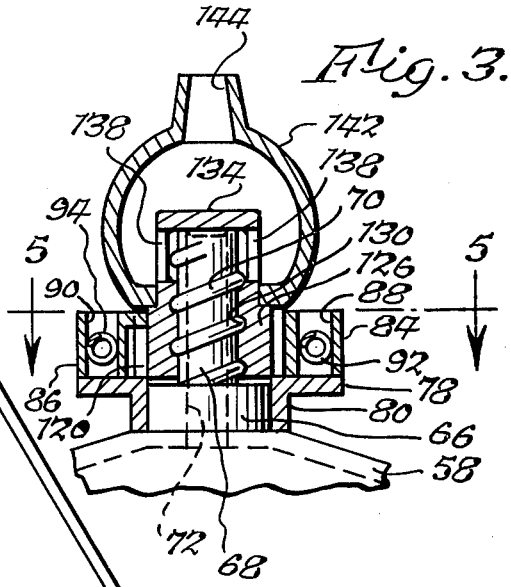
FIG. 3 is an enlarged sectional view taken about on line 3—3 of FIG. 1.
Figure 4:
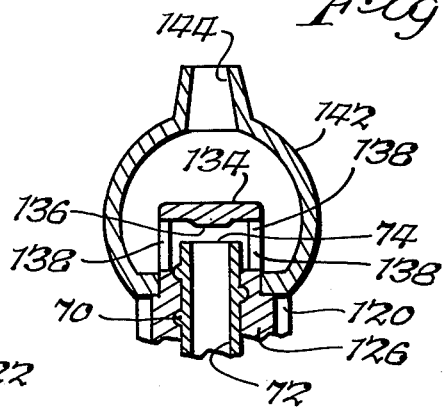
FIG. 4 is an enlarged sectional view of the nozzle and valve, the latter being shown in an open position, of the dispensing container of FIG. 1.
Figure 2:
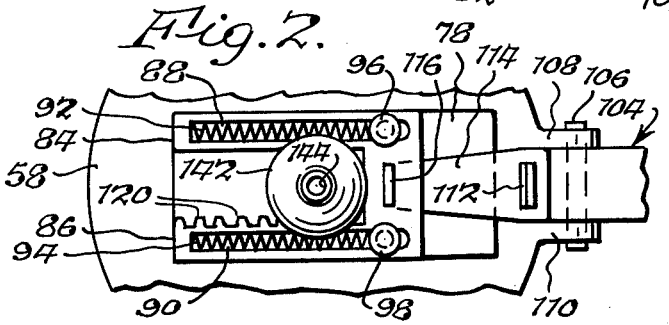
FIG. 2 is a fragmentary top plan view of the dispensing container of FIG. 1.

As shown in FIG. 3, cover 58 is formed to include an outlet conduit in fluid communication with the interior of container 10 and including a first portion 66 extending axially outwardly from cover 58 and having a relatively short axial length. Portion 68 is provided with threads 70 along the outer surface thereof for a purpose to be described. A common passage 72 thus is formed along within the portions 66 and 68, and the portion 68 terminates in an outlet end 74 as shown more clearly in FIG. 4. A base element of plastic or metal is provided which has a planar body portion 78 which is relatively thin and generally rectangular in overall shape as shown in FIG. 2, and the base element has a depending rim or neck portion 80 which fits snugly over the portion 66 as shown in FIG. 3 and which can be fixed or secured thereto in a suitable manner. The base element thus defines a planar supporting surface which is disposed in a plane generally perpendicular to the longitudinal axis of container 10.

Figure 5:
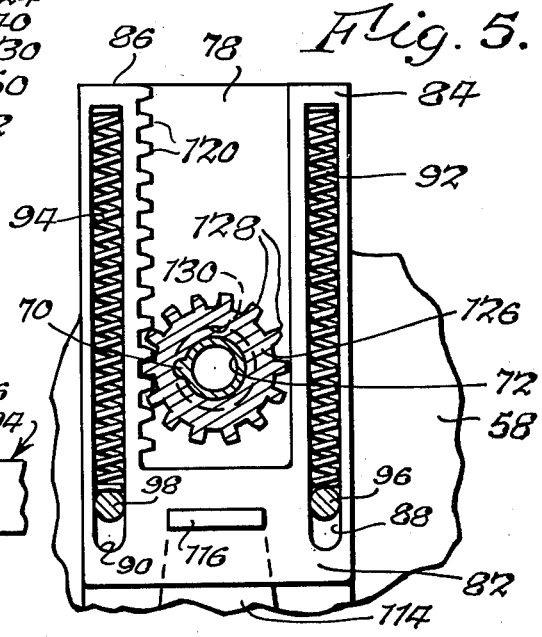
FIG. 5 is a sectional view taken about on line 5—5 of FIG. 3.

The dispensing means further includes manually-operated actuator means comprising an actuator element which is supported on base 78 and includes an end portion 82 and spaced apart arm portions 84, 86 which are disposed generally parallel and extend in the same direction from the end portion 82 as shown in FIGS. 2 and 5. The arms 84 and 86 are provided with elongated slots 88 and 90, respectively, extending therealong. The slots 88 and 90, in turn, contain spring elements 92 and 94, respectively. Suitable guides (not shown) can be provided for the springs, and each spring at one end contacts or is fixed to the end of the corresponding slot in which it is received and abuts or is fixed to a corresponding one of two stud elements 96 and 98, respectively, which extend through the slots and are fixed to the supporting element 78 in a suitable manner. For example, as shown in FIG. 1, an enlargement or boss 100 is formed on the lower surface of element 78 thereby providing a region to receive the end of the corresponding stud. Each stud is provided with a rounded head of a diameter greater than the width of the corresponding slot so that it is held therein. The shank portion of each stud is of a diameter permitting the corresponding slot to move therealong. Springs 92, 94 thus comprise biasing means operatively fixed with respect to container 10 for maintaining or urging element 78 in one position.

The actuator element is moved along and across the base element 78 by means of a manually operated handle lever generally designated 104. In particular, lever 104 is pivotally connected by means of a pin 106 connected to lever 104 approximately midway along the length thereof and which pin is rotatably received at opposite ends in bracket arm members 108 and 110 integrally formed on cover 58. Lever 104 thus is pivotally connected with respect to the container 10 about an axis perpendicular to the longitudinal axis of the container. The upper end of lever 104 is provided with a tip end 112 which fits in a slot at one end of a link element 114, the other end of which is provided with a tip end 116 which fits in a slot provided generally centrally of the portion 82 of the actuator element. The inner surface of one of the arm portions, in particular arm portion 86, of the actuator element is provided with teeth designated 120 along the entire length thereof thereby defining a rack for a purpose to be described.

The dispenser of the present invention further comprises a valve element of suitable material such as metal or plastic and having a nut pinion portion 126 at one end which is provided with external teeth 128 which engage or mesh with rack teeth 120. The nut pinion 126 is provided with internal threads 130 which are connected on the threads 70 of the conduit portion. The valve element further includes an end portion 134 formed to include a valve seat portion 136 on the inner surface thereof which is adapted to engage the outlet 74. A plurality of spaced circumferential passages are defined between the end portion 134 and the nut pinion portion 126 by a plurality of rod-like elements 138 circumferentially spaced therearound. The passages can of course be provided by other structural arrangements.

The dispenser according to the present invention further comprises a nozzle of plastic or metal and including a body 142 of generally hollow spherical shape which in the present illustration is provided with an opening enabling it to be fitted on and secured to the nut pinion portion 126. The hollow spherical body 142 surrounds or encloses the valve end portion 134, the passages defined by the rods 138, and the outlet opening 74. The nozzle is formed to include an outlet or orifice opening 144 which in the present illustration is located at the uppermost end as viewed in FIGS. 1–4.

The soft food dispenser according to the present invention operates in the following manner. The provision of threads 12, 14 at the opposite ends enable container 10 to serve two roles. The first is as a point of sale container whereby soft food is sold in container 10 to the consumer and kept therein until use. In this connection, container 10 simply is provided with standard internally threaded cap or closure elements at each end thereof. Then when the soft food stored therein is to be used, the consumer simply removes first one cap and replaces it with the dispensing assembly which is threaded onto that end of container 10, and then the consumer removes the other cap and replaces it with the piston assembly which is threaded onto that end of container 10.

The user then holds container 10 in one hand and rotates the knob 44 to advance the coil spring 18 through aperture 28 whereby the spring is compressed and accumulated in the region between cover wall 26 and piston head wall 36. With the dispensing assembly at the opposite end of container 10 being in a closed condition, the soft food within container 10 provides a resisting force on piston head 16 preventing axial movement thereof in response to compression and accumulation of spring 18. As a result, knob 44 can be rotated a number of times to advance a major portion of spring 18 to the region between walls 26, 36 thereby storing sufficient energy to ultimately move piston head 16 along the entire axial length of container 10 toward the opposite end thereby forcing or pushing all of the soft food material out from the container 10 and through the dispensing means when the latter is operated. The frictional contact or engagement between spring 18 and the edge surface of opening 28 holds or retains the portion of spring 18 forwardly of wall 26 and rearwardly of piston wall 36.

When the user desires to dispense an amount of the soft food, he simply holds container 10 directing the nozzle orifice opening 144 to the intended point of use of the food, such as onto a piece of bread or a cracker, and moves lever 104 in a clockwise direction as viewed in FIG. 1 through a somewhat small angle about pivot 106. The foregoing can be accomplished by a simple squeezing of the hand on lever 104 moving the extended end portion toward the container 10, and one can even hold container 10 and squeeze lever 104 using one hand if desired, although using both hands is preferred for added stabiltiy. Pivoting lever 104 about axis 106 as described draws or pulls the actuator element from left to right as viewed in FIGS. 1 and 2 against the biasing force of springs 92, 94. As the actuator element is moved along supporting element 78 and perpendicular to the axis of container 10, the rack teeth 120 meshing with pinion teeth 128 cause rotation of the valve element including nut pinion portion 126 about an axis coincident with the longitudinal axis of container 10. The pitch of threads 70 on conduit portion 68 and threads 130 within nut pinion portion 126 is sufficient to cause relatively rapid axial movement of the valve element on and along conduit 68. In other words, pivotal movement of handle lever 104 from the position shown in FIG. 1 to a position close or adjacent to the outer surface of container 10 results in movement of the valve element from a seated or closed position shown in FIG. 3 where end portion 134 seals the outlet end of conduit 68 to an unseated or open position shown in FIG. 4 where end portion 134 is spaced from the conduit end thereby opening outlet 74.

With the valve element in an open position, the piston head 16 is moved axially by the force of spring 18 to force the soft food from within container 10 out through passage 72 and outlet 74 through the passages defined by rod elements 138 and out through the nozzle orifice opening. The soft food material is dispensed in a positive flow from nozzle opening 144 for as long as the user maintains the handle 104 in the aforesaid position and as long as there remains food within container 10 to be dispensed. When the user releases handle 104, the biasing force of sprigs 92, 94 quickly and positively moves the actuator element in the opposite direction, i.e. from right to left as viewed in FIGS. 1 and 2, causing rack teeth 120 rotate pinion 126 in an opposite direction to return the valve element quickly and positively to a seated or closed position as shown in FIG. 3.

The quick and positive return of the valve element to a closed position, provided by the action of springs 92, 94 moving the actuator element which through the rack 120 and pinion 126 and threads 70 and 130 moves the valve element, eliminates any significant amount of waste of the soft food. The valve element is held firmly in a closed position by the springs and this is enhanced by the self-locking nature of the meshed rack teeth 120 and pinion teeth 128. The arrangement of handle 104 pivoting about axis 106 perpendicular to the axis of container 10 to move the actuator element perpendicular to the container axis enables convenient and easy manipulation. The foregoing is provided in a dispensing container which is relatively simple in construction and highly effective in operation.

It is therefore apparant that the present invention accomplishes its intended objects. While a single embodiment of the present invention has been described in detail, this is for the purpose of illustration, not limitation.

We claim:

1. A dispenser for fluent material such as soft food comprising:

a. a hollow container for storing the material to be dispensed;

b. piston means connected to one end of said container for pushing the stored material toward the other end of the container and comprising a piston head movable along within said container, biasing means in the form of a coil spring having one end operatively engaging said piston head for urging said piston head toward the opposite end of said container, partition means spaced from said piston head along said coil spring for defining a region for receiving and retaining a portion of said coil spring, said partition having an opening through which said spring extends, and manually-operated spring conditioning means operatively connected to the opposite end of said coil spring for introducing a portion of said coil spring into said region in a manner establishing sufficient stored energy in said spring to move said piston head along within said container a distance sufficient to force all of the material out from said container; and c. dispensing means connected to the other end of said container for controlling release of the material from said container and comprising conduit means leading from said container for conveying said material and terminating in an outlet, nozzle means in fluid communication with said outlet of said conduit means for discharging the material, and manually-operated valve means operatively between said outlet of said conduit means and said nozzle means and including a valve element movable axially toward and away from said conduit means between an open position spaced from said outlet and a closed position covering said outlet, biasing means normally urging said valve element into said closed position, and manually-operated actuator means operatively connected to said valve element for moving said element to said open position.

2. Apparatus according to claim 1, wherein said container is provided with threads at each end thereof and said piston means and nozzle means are threaded to said container whereby food can be stored in said container prior to dispensing and said container can be provided with caps threaded to said ends which caps are removed for installation of said nozzle means and said piston means.

3. Apparatus according to claim 1, wherein said conduit means extend from one end of said container along the longitudinal axis of said container and terminates in an outlet end, wherein said nozzle means includes a body portion surrounding said conduit outlet end and having an orifice opening therein, and wherein said valve means comprises a valve element connected to said conduit in a manner permitting relative axial movement, and having a portion adapted to sealingly contact said conduit outlet end and manually-operated actuator means operatively connected to said valve element for moving said valve element axially along said conduit between open and closed positions.

4. A dispenser for fluent material such as soft food comprising:

a. a hollow container for storing the material to be dispensed;

piston means connected to one end of said container for pushing the stored material toward the other end of the container and comprising a piston head movable along within said container, biasing means in the form of a coil spring urging said piston head toward the opposite end of the container, a closure element connected to said container and having an end surface providing a stop for said piston head at said one end of said container, said closure element having an opening in said end surface, said coil spring extending through said opening and having one end operatively engaging said piston head, and manually operated spring conditioning means rotatably connected to said closure element and fixed to the other end of said coil spring whereby in response to rotation of said conditioning means said spring is advanced into the region between said closure element end surface and said piston head, said opening being of a size to retain said spring therein by frictional engagement; and c. dispensing means connected to the other end of said container for controlling release of the material from said container and comprising conduit means leading from said container for conveying said material, nozzle means in fluid communication with said conduit means for discharging the material and manually operated valve means operatively between said conduit means and nozzle means and movable between open and closed positions for controlling communication between said conduit means and said nozzle means.

5. A dispenser for fluent material such as soft food comprising:

a. a hollow container for storing the material to be dispensed;

b. piston means connected to one end of said container for pushing the stored material toward the other end of the container and comprising a piston head movable along within said container and biasing means urging said piston head toward the opposite end of the container; and c. dispensing means connected to the other end of said container for controlling release of the material from the container and comprising conduit means leading from said container for conveying said material, said conduit means extending from one end of said container along the longitudinal axis of said container and terminating in an outlet end, nozzle means in fluid communication with said conduit means for discharging the material, said nozzle means including a body portion surrounding said conduit outlet end and having an orifice opening therein, and manually operated valve means operatively between said conduit means and nozzle means and movable between open and closed positions for controlling communication between said conduit means and said nozzle means, said valve means comprising a valve element connected to said conduit in a manner permitting relative axial movement and having a portion adapted to sealingly contact said conduit outlet end, manually-operated actuator means operatively connected to said valve element for moving said valve element axially along said conduit between open and closed positions, and biasing means operatively fixed with respect to said container and connected to said actuator means, said biasing means normally urging said actuator means to a position placing said valve element in a closed position.

6. A dispenser for fluent material such as soft food comprising:

a. a hollow container for storing the material to be dispensed;

b. piston means connected to one end of said container for pushing the stored material toward the other end of the container and comprising a piston head movable along within said container and biasing means urging said piston head toward the opposite end of the container; and c. dispensing means connected to the other end of said container for controlling release of the material from the container and comprising conduit means leading from said container for conveying said material, said conduit means extending from one end of said container along the longitudinal axis of said container and terminating in an outlet end, nozzle means in fluid communication with said conduit means for discharging the material, said nozzle means including a body portion surrounding said conduit outlet end and having an orifice opening therein, and manually operated valve means operatively between said conduit means and nozzle means and movable between open and closed positions for controlling communication between said conduit means and said nozzle means, said valve means comprising a valve element connected to said conduit in a manner permitting relative axial movement and having a portion adapted to sealingly contact said conduit outlet end, and manually-operated actuator means operatively connected to said valve element for moving said valve element axially along said conduit between open and closed positions, said actuator means comprising a manually-operated element operatively connected to said valve element and movable in opposite directions in a plane perpendicular to the longitudinal axis of said container, whereby movement of said actuator element in one direction causes axial movement of said valve element to said open position and movement of said actuator element in the opposite direction causes axial movement of said valve element to said closed position.

7. Apparatus according to claim 6 further including a lever pivotally connected with respect to said container about an axis perpendicular to the longitudinal axis of said container, said lever being movably connected at one end to said actuator element, the opposite end of said lever being spaced from said container for manual operation.

8. Apparatus according to claim 6 wherein said valve element includes a pinion portion and said actuator element includes a rack portion engaging said pinion portion.

* * * * *